US008618029B2

(12) United States Patent
Le Coent et al.

(10) Patent No.: US 8,618,029 B2
(45) Date of Patent: Dec. 31, 2013

(54) OVERBASED DETERGENTS FOR LUBRICATING OIL APPLICATIONS

(75) Inventors: Jean-Louis Le Coent, Le Havre (FR); Amedee Guellec, Saint-Sauveur d'emalleville (FR)

(73) Assignee: Chevron Oronite S.A., San Ramon, CA (US)

( * ) Notice: Subject to any disclaimer, the term of this patent is extended or adjusted under 35 U.S.C. 154(b) by 216 days.

(21) Appl. No.: 10/745,125

(22) Filed: Dec. 22, 2003

(65) Prior Publication Data

US 2005/0137098 A1 Jun. 23, 2005

(51) Int. Cl.
*C10M 159/24* (2006.01)

(52) U.S. Cl.
USPC ..... 508/392; 510/108; 510/184

(58) Field of Classification Search
USPC ..... 508/392; 510/184, 108
See application file for complete search history.

(56) References Cited

U.S. PATENT DOCUMENTS

| | | | | |
|---|---|---|---|---|
| 5,804,537 | A * | 9/1998 | Boffa et al. | 508/398 |
| 5,895,777 | A | 4/1999 | Ueda et al. | |
| 6,054,419 | A * | 4/2000 | Le Coent | 508/391 |
| 6,281,179 | B1 * | 8/2001 | Skinner et al. | 510/184 |
| 6,348,438 | B1 * | 2/2002 | Le Coent et al. | 508/332 |
| 6,479,440 | B1 * | 11/2002 | Le Coent | 508/398 |
| 2004/0235684 | A1 * | 11/2004 | Cook et al. | 508/234 |
| 2006/0052256 | A1 * | 3/2006 | Barnes et al. | 508/294 |

FOREIGN PATENT DOCUMENTS

| | | | |
|---|---|---|---|
| EP | 1059301 | A1 | 12/2000 |
| EP | 1154012 | A2 | 11/2001 |
| GB | 734598 | | 8/1955 |
| GB | 734622 | | 8/1955 |
| GB | 738359 | | 10/1955 |
| GB | 786167 | | 11/1957 |
| GB | 1146925 | | 3/1969 |
| WO | WO97/46644 | | 12/1997 |
| WO | WO 97/46644 | | 12/1997 |
| WO | WO97/46645 | | 12/1997 |
| WO | WO 97/46645 | | 12/1997 |
| WO | WO97/46647 | | 12/1997 |
| WO | WO 97/46647 | | 12/1997 |
| WO | WO99/28422 | | 6/1999 |
| WO | WO 99/28422 | | 6/1999 |

* cited by examiner

*Primary Examiner* — Cephia D Toomer
(74) *Attorney, Agent, or Firm* — Jones Day

(57) ABSTRACT

The present invention provides overbased detergents as lubricating oil additives effective for the lubrication of mechanical components in land and marine engines, such as, for example, hydraulic systems, transmissions, two-stroke and four-stroke vehicular engines, trunk piston and two-stroke crosshead marine engines. These overbased detergents lead to improved detergency and thermal stability performances versus high overbased sulfonates. Moreover, they are more compatible with commercial phenates than conventional sulfonates.

37 Claims, No Drawings

OVERBASED DETERGENTS FOR LUBRICATING OIL APPLICATIONS

The present invention relates to detergents for lubricating oil applications. In particular, the present invention relates to overbased detergents effective for the lubrication of mechanical components in land and marine engines. The preparation and use of such overbased detergents are described herein.

BACKGROUND OF THE INVENTION

Overbased detergents are well described to provide lubricating properties. Often such detergent additives are proportioned with other lubricating additives to provide lubricating oil compositions that exhibit certain desired lubricating properties. Overbased alkaline metal or alkaline-earth metal sulfonates are examples.

European Patent Application Publication No. 1,059,301A1 describes alkaline-earth metal aralkylsulfonates having improved detergent and dispersant properties.

International Application WO 97/46644 describes a calcium overbased detergent comprising a surfactant system derived from at least two surfactants, in which at least one of the surfactants is a sulfurised or non-sulfurised phenol, or at least one other of the surfactants is other than a phenol, for example a sulfonic acid derivative, the proportion of phenol in the surfactant system being at least 35% by mass, and the TBN/% surfactant ratio of said detergent being at least 15.

International Application WO 97/46645 describes a calcium overbased detergent comprising a surfactant system derived from at least two surfactants in which at least one of the surfactants is a sulfurised or non-sulfurised phenol, or at least one other of the surfactants is a sulfurised or non-sulfurised salicylic acid, the total proportion of said phenol and of said salicylic acid in the surfactant system being at least 55% by mass, and the TBN/% surfactant ratio of said detergent being at least 11.

International Application WO 97/46647 describes a calcium overbased detergent comprising a surfactant system derived from at least two surfactants in which at least one of the surfactants is a sulfurised or non-sulfurised phenol, or at least one other of the surfactants is other than a phenol, for example an alkylarylsulfonate, the proportion of phenol in the surfactant system being at least 15% by mass, and the TBN/% surfactant ratio of said detergent being at least 21.

International Application WO 99/28422 describes a lubricating oil composition comprising a mixture of at least two detergents containing metals, namely, a) a phenate, sulfonate, salicylate, naphthenate or metal carboxylate, and b) an overbased calcium detergent comprising a surfactant system derived from at least two surfactants in which at least one of the surfactants is a sulfurised or non-sulfurised phenol, or at least one other surfactant is other than a phenol, the proportion of phenol in the surfactant system being at least 45% by mass, and the TBN/% surfactant ratio of said detergent being at least 14.

SUMMARY OF THE INVENTION

The present invention provides overbased detergents as lubricating oil additives effective for the lubrication of mechanical components in land and marine engines, such as, for example, hydraulic systems, transmissions, two-stroke and four-stroke vehicular engines, trunk piston and two stroke crosshead marine engines. Accordingly, the present invention relates to a lubricating oil additive comprising a product obtained by the process of:

I. preparing a surfactant system comprising:
- (A) at least one alkyl aromatic sulfonate of an alkaline-earth metal comprising:
  - (i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 9% to 70%, and
  - (ii) from about 0 wt % to 50 wt % of a branched mono alkyl aromatic sulfonate in which the branched alkyl group contains from about 14 to 30 carbon atoms, and
- (B) at least one oil-soluble reactant selected from the group consisting of:
  - (i) an alkylhydroxybenzoic acid or the alkaline metal or alkaline-earth metal salt thereof,
  - (ii) a carboxylate detergent-dispersant additive obtained by:
    - (a) neutralizing alkylphenols using an alkaline-earth metal base, forming an intermediate product; and
    - (b) carboxylating the intermediate product using carbon dioxide so that at least 5 wt % of the original alkylphenol starting material has been converted to alkaline-earth metal single aromatic-ring hydrocarbyl salicylate; and
  - (iii) a sulfurized or non-sulfurized alkylphenol or the alkaline metal or alkaline-earth metal salt thereof,
  - wherein the alkyl group in each of (B)(i) to (B)(iii) is independently a linear or branched alkyl group, or mixture of linear and branched alkyl groups having from about 9 to 160 carbon atoms, and II. reacting the resultant surfactant system with a source of alkaline-earth metal base and at least one acidic co-agent.

Preferably, the linear mono alkyl group of the linear mono alkyl aromatic sulfonate is derived from an alkyl group containing from about 18 to 30 carbon atoms, more preferably from about 20 to 24 carbon atoms. The linear mono alkyl group of the linear mono alkyl aromatic sulfonate is preferably derived from a normal alpha olefin containing from about 18 to 40, more preferably, from about 20 to 24, carbon atoms.

The mole % of the aromatic sulfonate group fixed on the 1 or 2 position of the linear alkyl chain is preferably from about 10% to 30%; more preferably, from about 13% to 25%, and most preferably, from about 15% to 25%.

The branched mono alkyl group of the branched mono alkyl aromatic sulfonate preferably contains from about 14 to 18 carbon atoms. The resulting molecular weight of the starting mono alkyl aromatic compound is about 330 or less. Preferably, the alkyl group on the branched mono alkyl aromatic sulfonate is derived from a polymer of propylene.

Preferably, at least 10 wt %, more preferably at least 20 wt %, and most preferably at least 50 wt % of the alkyl groups in each of (B)(i) to (B)(iii) are linear alkyl having from about 18 to 30 carbon atoms.

Moreover, preferably, at least 10 wt %, more preferably, at least 20 wt % of the alkyl groups in each of (B)(i) to (B)(iii) are linear alkyl having from about 18 to 30 carbon atoms when (B) is at least one of (B)(i) or (B)(ii).

Preferably, at least 10 wt %, more preferably, at least 20 wt %, of the original alkylphenol starting material defined in (B)(ii)(b) has been converted to alkaline-earth metal single aromatic-ring hydrocarbyl salicylate.

Preferably, the acidic co-agent is carbon dioxide or boric acid or mixtures thereof.

Preferably, the proportion of phenol in the surfactant system is less than 15 wt %.

The Total Base Number (TBN) of the lubricating oil additive is preferably greater than about 250 and more preferably greater than 400.

In another embodiment, the present invention relates to a lubricating oil composition comprising a major amount of a base oil of lubricating viscosity and a minor amount of the lubricating oil additive of the present invention.

In still another, the present invention relates to a process for making the lubricating oil composition of the present invention comprising mixing a base oil of lubricating viscosity and the lubricating additive of the present invention.

In yet another embodiment, the present invention relates to a method of lubricating a hydraulic system by contacting the hydraulic system with the lubricating oil composition of the present invention.

Among other factors, the present invention is based on the surprising discovery that a lubricating oil additive containing certain overbased detergents exhibits improved lubricating properties. Specifically, the lubricating oil additive of the present invention provides improved detergency and thermal stability, and is more compatible with phenates than conventional detergents. The present invention has a wide variety of applications useful for the lubrication of mechanical components in land and marine engines, such as, for example, hydraulic systems, transmissions, two-stroke and four-stroke vehicular engines, trunk piston and two-stroke crosshead marine engines.

DETAILED DESCRIPTION OF THE INVENTION

Prior to discussing the present invention in detail, the following terms will have the following meanings unless expressly stated to the contrary.

Definitions

The term "alkaline-earth metal" refers to calcium, barium, magnesium and strontium, with calcium being preferred.

The term "alkali metal" or "alkaline metal" refers to lithium, sodium or potassium, with potassium being preferred.

The term "aryl group" is a substituted or non-substituted aromatic group, such as the phenyl, tolyl, xylyl, ethylphenyl and cumenyl groups.

The term "hydrocarbyl" refers to an alkyl or alkenyl group.

The term "mole % of the aromatic sulfonate group fixed on the 1 or 2 position of the linear alkyl chain" refers to the mole percentage of all the aromatic sulfonate groups fixed on the linear alkyl chain that are fixed at the first and second position of the linear alkyl chain.

The term "overbased" refers a class of metal salts or complexes. These materials have also been referred to as "basic", "superbased", "hyperbased", "complexes", "metal complexes", "high-metal containing salts", and the like. Overbased products are metal salts or complexes characterized by a metal content in excess of that which would be present according to the stoichiometry of the metal and the particular acidic organic compound reacted with the metal, e.g., a sulfonic acid.

The term "surfactant" refers to the salified entity of the lubricating agent (alkaline-earth metal hydrocarbylsulfonate expressed as "alkylaryl sulfonic acid", alkaline hydroxybenzoate expressed as "hydroxybenzoic acid", alkaline-earth metal alkylcarboxylate expressed as "hydroxybenzoic acid", alkaline alkylphenate expressed as "phenol", alkaline-earth metal alkylphenate expressed as "phenol").

The term "total surfactant" refers to the salified part of all the lubricating agents defined above under (A) and (B) of the surfactant system.

The term "free alkylphenol" refers to the non-salified product originating from the dialysis of an alkaline or alkaline-earth metal alkylphenate. The proportion of phenol to total surfactant is determined from the amount of salified alkylphenol only.

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D2896 or equivalent procedure.

In the present description, the content of alkylphenate, alkylarylsulfonate, alkylcarboxylate and alkylhydroxybenzoate surfactants is expressed in their free form (non-salified), i.e. in the form of phenol, alkylarylsulfonic acid and hydroxybenzoic acid, respectively. Their respective proportions, as a percentage of the total surfactant, are obtained by chemical analysis according to the method below:

Determination of the Content of Surfactant by Chemical Analysis

1. Dialysis

Principle:

Dialysis is the term corresponding to molecular extraction by a solvent. A known quantity (approximately 20 g) of the lubricating oil additive composition (A) is poured into a latex finger-shaped mould. The solvent under reflux washes the product and brings about the migration of the unreacted constituents (alkylphenol+oil) through the membrane (dialysate).

The salified fraction (alkaline-earth metal or alkaline metal salts) remains inside the membrane and is called "residue". After drying at a temperature greater than or equal to 100° C., the mass of the dried residue in grams is called residue A1. The percentage A2 of dry residue in the liquid sample is given by the formula:

$$A2 = \frac{A1}{A} \times 100$$

2. Determination of the Total Surfactant Percentage

A known quantity (approximately 10 g) of the dry residue (B) above is hydrolyzed with hydrochloric acid (in such a quantity that acidification/hydrolysis is complete). By extraction with ether, two phases are obtained:

- the aqueous phase containing the inorganic salts such as $CaCl_2$, and
- the organic ethereal phase containing the surfactants in their acidified form, namely phenol, alkylarylsulfonic acid, and hydroxybenzoic acid. This phase is dried, then the ether is evaporated at 110° C. under vacuum in order to produce a hydrolyzed dry residue which is then weighed to give a mass B1 (g).

The total surfactant percentage in the starting composition is given by the formula:

$$X = \frac{B1}{B} \times A2$$

3.

Calculation of the $Y = TBN/\%$ Total Surfactant Ratio $$Y = \frac{TBN \text{ of the lubricating composition}}{X}$$

where X is as defined in the formula above.

4. Determination of the Percentage of Each of the Surfactants (in Non-Salified Form)

A known quantity (approximately 1 g) of the hydrolyzed dry residue (Sg) obtained as described above is analyzed.

The percentage S1 of alkylarylsulfonic acid is obtained by potentiometry with dibutylamine titration.

The percentage of phenol+hydroxybenzoic acid is 100-S1. The percentage of phenol (S2) and the percentage of hydroxybenzoic acid (S3) is obtained by potentiometry using tetrabutyl ammonium hydroxide titration.

Alkyl Aromatic Sulfonates

The alkyl aromatic sulfonate employed in the present invention is characterized in that it comprises from about 50 wt % to 100 wt % of a linear mono alkyl aromatic sulfonate and from about 0 wt % to 50 wt % of a branched mono alkyl aromatic sulfonate. In one preferred embodiment, the alkyl aromatic sulfonate is a 100 wt % linear mono alkyl aromatic sulfonate. In another preferred embodiment, the alkyl aromatic sulfonate is a mixture of from about 50 wt % to 99 wt %, preferably from about 50 wt % to 70 wt %, of a linear mono alkyl aromatic sulfonate and from about 1 wt % to 99 wt %, preferably from about 30 wt % to 50 wt % of a branched mono alkyl aromatic sulfonate. This mixture is useful as a detergent/dispersant additive for lubricating oils.

Linear Mono Alkyl Aromatic Sulfonates

The linear mono alkyl group of the linear mono alkyl aromatic sulfonate contains from about 14 to 40 carbon atoms, preferably from about 18 to 30, more preferably from about 20 to 24, carbon atoms. Preferably, the linear mono alkyl group is derived from a normal alpha olefin containing preferably from about 14 to 40, more preferably, from about 20 to 24 carbon atoms. The mole % of the aromatic sulfonate group fixed on the 1 or 2 position of the linear alkyl chain is preferably from about 10% to 30%; more preferably, from about 13% to 25%; and most preferably, from about 15% to 25%.

Branched Mono Alkyl Aromatic Sulfonate

The branched mono alkyl group of the branched mono alkyl aromatic sulfonate contains from about 14 to 18 carbon atoms. The resulting molecular weight of the starting mono alkyl aromatic compound is about 300 or less. Preferably, the alkyl group on the branched mono alkyl aromatic sulfonate is derived from a polymer of propylene.

Mixture of Alkyl Aromatic Sulfonates

In one embodiment, the mixture of alkyl aromatic sulfonates of alkaline-earth metal is prepared by the mixing of the corresponding linear mono alkyl aromatic and branched mono alkyl aromatic, the sulfonation of the mixture of mono alkyl aromatics, and the reaction of the resulting alkyl aromatic sulfonic acids with an excess of alkaline-earth metal base.

In another embodiment, the mixture of alkyl aromatic sulfonates of alkaline-earth metal is prepared by the separate preparation of each of the alkyl aromatic sulfonic acids, their mixing, and their reaction with an excess of base.

In a third embodiment, the mixture of alkyl aromatic sulfonates of alkaline-earth metal is prepared by the separate preparation of each of the alkyl aromatic sulfonates entering into the composition of the mixtures and their mixing in the requisite proportions.

Preferably, the mixture of alkyl aromatic sulfonates of alkaline-earth metal is a calcium alkylarylsulfonate mixture.

Alkaline Metal or Alkaline-Earth Metal Alkylhydroxybenzoic Acid

When present, the alkali metal alkylhydroxybenzoic acid employed in the present invention will typically have a structure as shown below as Formula (I).

Formula I

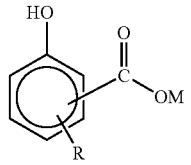

(I)

wherein R is a linear or branched aliphatic group. Preferably, R is an alkenyl or alkyl group. More preferably, R is an alkyl group. M is an alkali metal selected from the group consisting of lithium, sodium, and potassium. Potassium is the preferred alkali metal.

Alkaline earth-metal salts of alkylhydroxybenzoic acid are also contemplated for use in the present invention. Suitable alkaline-earth metal salts include calcium, barium, magnesium and strontium salts. The preferred alkaline-earth metal salt of alkylhydoxybenzoic acid is the calcium salt.

In formula (I) above, when R is a linear aliphatic group, it typically comprises from about 20 to 40, preferably from about 22 to 40 carbon atoms, and more preferably from about 20 to 30 carbon atoms.

When R is a branched aliphatic group, it typically comprises from about 9 to 40 carbon atoms, and more preferably, from about 12 to 20 carbon atoms. Such branched aliphatic groups are preferably derived from an oligomer of propylene or butene.

R can also represent a mixture of linear or branched aliphatic groups. Preferably, R represents a mixture of linear alkyl containing from about 20 to 30 carbon atoms and branched alkyl containing about 12 carbon atoms.

When R represents a mixture of aliphatic groups, the alkaline metal or alkaline-earth metal alkylhydroxybenzoic acid employed in the present invention may contain a mixture of linear groups, a mixture of branched groups, or a mixture of linear and branched groups. Thus, R can be a mixture of linear aliphatic groups, preferably alkyl, for example mixtures of $C_{14}$-$C_{18}$, $C_{16}$-$C_{18}$, $C_{18}$-$C_{30}$, $C_{20}$-$C_{22}$, $C_{20}$-$C_{24}$ or $C_{20}$-$C_{28}$ linear groups. Advantageously, these mixtures include at least 95 mole %, preferably 98 mole % of alkyl groups.

The alkaline metal or alkaline-earth metal alkylhydroxybenzoic acid of the present invention wherein R represents a mixture of alkyl groups, can be prepared from linear alpha olefin cuts, such as those marketed by Chevron Phillips Chemical Company under the names Alpha Olefin $C_{26-28}$ or Alpha Olefin or $C_{20-24}$, by British Petroleum under the name $C_{20-28}$ Olefin, by Shell Chimie under the name SHOP C20-22, or mixtures of these cuts or olefins from these companies having from about 20 to 28 carbon atoms.

The —COOM group of Formula (I) can be in the ortho, meta or para position with respect to the hydroxyl group.

The alkaline metal or alkaline-earth metal alkylhydroxybenzoic acid employed in the present invention can be any mixture of alkaline metal or alkaline-earth metal alkylhydroxybenzoic acid having the —COOM group in the ortho, meta or para position.

Preferably, the alkylhydroxybenzoic acid or the alkaline metal or alkaline-earth metal salt thereof is potassium alkylhydroxybenzoate.

The alkali or alkaline-earth metal alkylhydroxybenzoates employed in the present invention are generally soluble in oil as characterized by the following test.

A mixture of a 600 Neutral diluent oil and the alkylhydroxybenzoate at a content of 10 wt % with respect to the total weight of the mixture is centrifuged at a temperature of 60° C. and for 30 minutes, the centrifugation being carried out under the conditions stipulated by the standard ASTM D2273 (it should be noted that centrifugation is carried out without dilution, i.e. without adding solvent); immediately after centrifugation, the volume of the deposit which forms is determined; if the deposit is less than 0.05% v/v (volume of the deposit with respect to the volume of the mixture), the product is considered as soluble in oil.

Advantageously, the TBN of the alkaline metal or alkaline-earth metal alkylhydroxybenzoic acid of the present invention is lower than 100, preferably from about 10 to 95.

Determination of Physical and Chemical Properties

K %, Ca %, and S % were measured by an X-ray method.

Appearance in the oil: this method evaluates the appearance of an additive sample for storage stability at a concentration of 10% in 600 Neutral diluent oil. The appearance of the solution was examined after 30 days at ambient temperature. If the appearance of the solution was "bright", the rating was (1), if "light cloud", the rating was (2), if "moderate cloud", the rating was (3). Rating of sediment: absent (0), light (1), average (2), considerable (3).

1/0=clear product/absence of sediment.

Viscosity was measured at the temperature of 100° C. following method ASTM D 445.

Sediment was measured by following ASTM D 2273.

The term "Total Base Number" or "TBN" refers to the amount of base equivalent to milligrams of KOH in one gram of sample. Thus, higher TBN numbers reflect more alkaline products and therefore a greater alkalinity reserve. The TBN of a sample was determined by ASTM D 2896.

% CaS or % Ca as calcium sulfonate measurement:

The percentage of soap (calcium sulfonate) was determined by ASTM (D 3712). CaS wt % (calcium linked to sulfonic acid) was determined based on the total percentage of calcium sulfonate and molecular weight of calcium and sulfonic acid.

Carboxylate Detergent-Dispersant Additive

The lubricating oil additive of the present invention may comprise a carboxylate detergent-dispersant additive as shown in Formula (II) below (also referred to herein as "carboxylate" or "carboxylated detergent").

Formula II

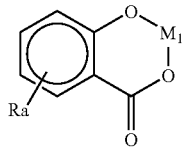

wherein $R_a$ is a linear or branched aliphatic group. Preferably, R is an alkenyl or alkyl group. More preferably, $R_a$ is an alkyl group. $M_1$ is an alkaline-earth metal selected from the group consisting of barium, calcium, magnesium, and strontium. Calcium is preferred.

The carboxylate detergent-dispersant additive may be prepared by the following process.

A. Neutralization Step

In the first step, alkylphenols are neutralized using an alkaline-earth metal base in the presence of at least one carboxylic acid that contains from about 1 to 4 carbon atoms, i.e., $C_1$ to $C_4$ as a promoter. This reaction is carried out in the absence of alkaline metal base, and in the absence of dialcohol or monoalcohol.

The hydrocarbyl phenols may contain up to 98 wt % linear hydrocarbyl groups, up to 100 wt % branched hydrocarbyl groups, or both linear and branched hydrocarbyl groups. Preferably, the linear hydrocarbyl group, if present, is alkyl, and the linear alkyl group contains from about 12 to 40 carbon atoms, more preferably from about 18 to 30 carbon atoms. The branched hydrocarbyl group, if present, is preferably alkyl and contains at least 9 carbon atoms, preferably from about 9 to 24 carbon atoms, more preferably from about 10 to 18 carbon atoms. In one embodiment, the hydrocarbyl phenols contain up to 85 wt % of linear hydrocarbyl phenol (preferably at least 35 wt % linear hydrocarbyl phenol) in mixture with at least 15 wt % of branched hydrocarbyl phenol.

The use of an alkylphenol containing up to at least 35 wt % of long linear alkylphenol (from about 18 to 30 carbon atoms) is particularly attractive because a long linear alkyl chain promotes the compatibility and solubility of the additives in lubricating oils. However, the presence of relatively heavy linear alkyl groups in the alkylphenols makes the latter less reactive than branched alkylphenols, hence the need to use harsher reaction conditions to bring about their neutralization by an alkaline-earth metal base.

Branched alkylphenols can be obtained by reaction of phenol with a branched olefin, generally originating from propylene. They consist of a mixture of monosubstituted isomers, the great majority of the substituents being in the para position, very few being in the ortho position, and hardly any in the meta position. That makes them relatively reactive towards an alkaline-earth metal base, since the phenol function is practically devoid of steric hindrance.

On the other hand, linear alkylphenols can be obtained by reaction of phenol with a linear olefin, generally originating from ethylene. They consist of a mixture of monosubstituted isomers in which the proportion of linear alkyl substituents in the ortho, meta, and para positions is much more uniformly distributed. This makes them much less reactive towards an alkaline-earth metal base since the phenol function is much less accessible due to considerable steric hindrance, due to the presence of closer and generally heavier alkyl substituents. Of course, linear alkylphenols may contain alkyl substituents with some branching which increases the amount of para substituents and, resultantly, increases the relative reactivity towards alkaline earth metal bases.

The alkaline-earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, slaked lime (calcium hydroxide) is preferred.

The promoter used in this step can be any material that enhances neutralization. For example, the promoter may be a polyhydric alcohol, ethylene glycol or any carboxylic acid. Preferably, a carboxylic acid is used. More preferably, $C_1$ to $C_4$ carboxylic acids are used in this step include formic, acetic, propionic and butyric acid, and may be used alone or in mixture. Preferably, a mixture of acids is used, most preferably a formic acid/acetic acid mixture. The molar ratio of formic acid/acetic acid should be from about 0.2:1 to 100:1, preferably from about 0.5:1 and 4:1, and most preferably about 1:1. The carboxylic acids act as transfer agents, assisting the transfer of the alkaline-earth metal bases from a mineral reagent to an organic reagent.

The neutralization operation is carried out at a temperature of at least 200° C., preferably at least 215° C., and, more preferably, at least 240° C. The pressure is reduced gradually below atmospheric in order to distill off the water of reaction. Accordingly, the neutralization should be conducted in the absence of any solvent that may form an azeotrope with water. Preferably, the pressure is reduced to no more than 7,000 Pa (70 mbars).

The quantities of reagents used should correspond to the following molar ratios:

(1) alkaline-earth metal base/alkylphenol from about 0.2:1 to 0.7:1, preferably from about 0.3:1 to 0.5:1; and (2) carboxylic acid/alkylphenol from about 0.01:1 to 0.5:1, preferably from about 0.03:1 to 0.15:1.

Preferably, at the end of this neutralization step the alkylphenate obtained is kept for a period not exceeding fifteen hours at a temperature of at least 215° C. and at an absolute pressure from about 5,000 to $10^5$ Pa (between 0.05 and 1.0 bar). More preferably, at the end of this neutralization step the alkylphenate obtained is kept for between two and six hours at an absolute pressure from about 10,000 to 20,000 Pa (between 0.1 and 0.2 bar).

By providing that operations are carried out at a sufficiently high temperature and that the pressure in the reactor is reduced gradually below atmospheric, the neutralization reaction is carried out without the need to add a solvent that forms an azeotrope with the water formed during this reaction.

B. Carboxylation Step

The carboxylation step is conducted by simply bubbling carbon dioxide into the reaction medium originating from the preceding neutralization step and is continued until at least 5 wt % of the starting alkylphenol has been converted to alkylsalicylate (measured as salicylic acid by potentiometric determination). It must take place under pressure in order to avoid any decarboxylation of the alkylsalicylate that forms.

Preferably, at least 10 mole %, and more preferably, 20 mole %, of the starting alkylphenols is converted to alkylsalicylate using carbon dioxide at a temperature between 180° C. and 240° C., under a pressure within the range of from above atmospheric pressure to $15\times10^5$ Pa (15 bars) for a period of one to eight hours.

According to one variant, at least 25 mole % of the starting alkylphenols is converted to alkylsalicylate using carbon dioxide at a temperature equal to or greater than 200° C. under a pressure of $4\times10^5$ Pa (4 bars).

C. Filtration Step

The product of the carboxylation step may advantageously be filtered. The purpose of the filtration step is to remove sediments, and particularly crystalline calcium carbonate, which might have been formed during the preceding steps, and which may cause plugging of filters installed in lubricating oil circuits.

D. Separation Step (Optional)

At least 10 wt % of the unreacted alkylphenol is separated from the product of the carboxylation step. Preferably, the separation is accomplished using distillation. More preferably, the distillation is carried out in a wiped film evaporator at a temperature of from about 150° C. to 250° C. and at a pressure of from about 0.1 to 4 mbar; more preferably from about 190° C. to 230° C. and at from about 0.5 to 3 mbar; most preferably from about 195° C. to 225° C. and at a pressure of from about 1 to 2 mbar. At least 10 wt % of the unreacted alkylphenol is separated. More preferably, at least 30 wt % of the unreacted alkylphenol is separated. Most preferably, up to 55 wt % of the unreacted alkylphenol is separated. The separated unreacted alkylphenol may then be recycled to be used as starting materials in the present process or in other processes.

The carboxylated detergent-dispersant additive formed by this process can be characterized by its unique composition, with much more alkaline-earth metal single aromatic-ring hydrocarbyl salicylate and less alkylphenol than produced by other routes. The reaction product (at the filtration step before separation step) will typically have the following composition:

a) from about 40% to 60% unreacted alkylphenol, b) from about 10% to 40% alkaline-earth metal alkylphenate, and c) from about 20% to 40% alkaline-earth metal single aromatic-ring alkylsalicylate.

The preceding process is more fully described in U.S. Pat. No. 6,162,770, which is incorporated by reference into this application.

Unlike alkaline-earth metal alkylsalicylates produced by other processes, this carboxylate detergent-dispersant additive composition can be characterized by having only minor amounts of an alkaline-earth metal double aromatic-ring alkylsalicylate. The mole ratio of single aromatic-ring alkylsalicylate to double aromatic-ring alkylsalicylate is at least 8:1.

Preferably, the TBN of the carboxylate detergent-dispersant additive should be from about 75 to 250, more preferably from about 100 to 150.

The lubricating additive of the present invention may also contain an alkaline or alkaline-earth metal alkylphenate of Formulas (III) or (IV) below.

Formula III

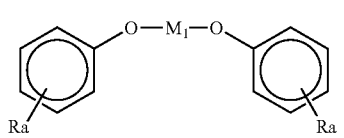

-continued

Formula IV

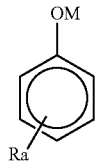

wherein the $R_a$ group is a linear or branched aliphatic group. Preferably, $R_a$ is an alkenyl or alkyl group. More preferably, $R_a$ is an alkyl group. M is an alkaline metal selected from the group consisting of lithium, sodium, and potassium. Potassium is preferred. $M_1$ is an alkaline-earth metal selected from the group consisting of barium, calcium, magnesium, and strontium. Calcium is preferred.

According to an advantageous aspect, when the oil-soluble reactants (B) of the lubricating additive of the present invention consists of at least one alkylhydroxybenzoic acid or the alkaline metal or alkaline-earth metal salt thereof or a carboxylate detergent-dispersant as defined under (B)(i) and (B)(ii), at least 10 wt %, preferably at least 20 wt %, and more preferably at least 50 wt %, of the oil-soluble reactant comprises a linear alkyl group having from about 20 to 30 carbon atoms.

Sulfurized and Non-Sulfurized Alkylphenol

Advantageously when the lubricating agent (B) contains a sulfurized or non-sulfurized alkylphenol or the alkaline metal or alkaline-earth metal salts thereof, for example, an alkylphenol, an alkaline alkylphenate, and/or an alkaline-earth alkylphenate, the phenol/total surfactant weight ratio, determined according to the method of determination by chemical analysis indicated above, is lower than 15%.

The metal base used in preparing the overbased products employed in the present invention is selected from the group consisting of alkaline metals, alkaline-earth metals, mixtures of two or more thereof, or basically reacting compounds thereof. Preferably, the metal is an alkaline metal, alkaline-earth metal, or a mixture of two or more thereof. Lithium, sodium, potassium, magnesium, calcium and barium are useful, with lithium, sodium, and potassium being especially useful. Calcium is also preferred.

Useful acidic co-agents in preparation of the overbased products employed in the present invention are carbamic acid, acetic acid, formic acid, boric acid, trinitromethane, $SO_2$, $CO_2$, sources of said acids, and mixtures thereof. $CO_2$ and $SO_2$, and sources thereof, are preferred. Useful sources of $CO_2$ include urea, carbamates and ammonium carbonates. Useful sources of $SO_2$ include sulfurous acid, thiosulfuric acid and dithionous acid. $CO_2$ is especially preferred.

Lubricating Oil Composition

The present invention also relates to a lubricating oil composition containing the lubricating oil additive of the present invention. Such a lubricating oil composition will comprise a major amount of a base oil of lubricating viscosity and a minor amount of a lubricating oil additive obtained by the process of:

(I) preparing a surfactant system comprising:

(A) at least one alkyl aromatic sulfonate of alkaline-earth metals comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 9% to 70%, and (ii) from about 0 wt % to 50 wt % of a branched mono alkyl aromatic sulfonate in which the branched alkyl group contains from about 14 to 30 carbon atoms, and (B) at least one oil-soluble reactant selected from the group consisting of:

(i) an alkylhydroxybenzoic acid or the alkaline metal or alkaline-earth metal salt thereof, (ii) a carboxylate detergent-dispersant additive obtained by:

(a) neutralizing alkylphenols using an alkaline-earth metal base, forming an intermediate product; and (b) carboxylating the intermediate product using carbon dioxide so that at least 5 wt % of the original alkylphenol starting material has been converted to alkaline-earth metal single aromatic-ring hydrocarbyl salicylate; and (iii) a sulfurized or non-sulfurized alkylphenol or the alkaline metal or alkaline-earth metal salt thereof, wherein the alkyl group in each of (B)(i) to (B)(iii) is independently a linear, branched, or mixture of linear and branched alkyl groups having from about 9 to 160 carbon atoms, and (II) reacting the resultant surfactant system with alkaline-earth metal base and at least one acidic co-agent.

Base Oil of Lubricating Viscosity

The base oil of lubricating viscosity employed in the present invention may be mineral oils or synthetic oils. A base oil having a viscosity of at least 10 cSt ($mm^2/s$) at 40° C. and a pour point below 20° C., preferably at or below 0° C. is desirable. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene or higher alpha olefin (polyalphaolefin or PAO), or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful. For example, blends of 10 wt % to 25 wt % hydrogenated 1-decene trimer with 75 wt % to 90 wt % 150 SUS (100° F.) mineral oil make excellent lubricating oil bases.

The lubricating oil composition according to the present invention can preferably have a TBN greater than or equal to 250, including from about 300 to 500, as well as greater than 500.

An advantageous lubricating oil composition according to the present invention comprises, as a total weight ratio of the composition, from about 10% to 50% of a base oil of lubricating viscosity, from about 12% to 40% of a mixture of alkyl aromatic sulfonates of alkaline-earth metals, from about 0% to 35% of an alkylhydroxybenzoic acid or the alkaline metal or alkaline-earth metal salt, and from about 0% to 35% of a carboxylate detergent-dispersant additive, from about 0% to 20% sulfurized or non-sulfurized alkylphenols or the alkaline metal or alkaline-earth metal salt thereof, wherein the sum of the different constituents being equal to 100% and the constituents being as defined above.

Another advantageous lubricating oil composition according to the present invention comprises, as a total weight ratio of the composition, from about 10% to 50% of a base oil of lubricating viscosity, from about 12% to 40% of a mixture of alkyl aromatic sulfonates of alkaline-earth metals, from about 0% to 40% of an alkylhydroxybenzoic acid or the alkaline metal or alkaline-earth metal salt, from about 0% to 40% of a carboxylate detergent-dispersant additive, and from about 0% to 25% sulfurized or non-sulfurized alkylphenols or the alkaline metal or alkaline-earth metal salt thereof, wherein the sum of the different constituents being equal to 100% and the constituents being as defined above.

| Other Additive Packages | | |
|---|---|---|
| Marine Diesel Engine Oils | | |
| 1) | Unsulfurized, carboxylate-containing additive | 65% |
| | Primary alkyl zinc dithiophosphate | 5% |
| | Oil of lubricating viscosity | 30% |
| 2) | Unsulfurized, carboxylate-containing additive | 65% |
| | Alkenyl succinimide ashless dispersant | 5% |
| | Oil of lubricating viscosity | 30% |
| 3) | Unsulfurized, carboxylate-containing additive | 60% |
| | Primary alkyl zinc dithiophosphate | 5% |
| | Alkenyl succinimide ashless dispersant | 5% |
| | Oil of lubricating viscosity | 30% |
| 4) | Unsulfurized, carboxylate-containing additive | 65% |
| | Phenol type oxidation inhibitor | 10% |
| | Oil of lubricating viscosity | 25% |
| 5) | Unsulfurized, carboxylate-containing additive | 55% |
| | Alkylated diphenylamine-type oxidation inhibitor | 15% |
| | Oil of lubricating viscosity | 30% |
| 6) | Unsulfurized, carboxylate-containing additive | 65% |
| | Phenol-type oxidation inhibitor | 5% |
| | Alkylated diphenylamine-type oxidation inhibitor | 5% |
| | Oil of lubricating viscosity | 25% |
| 7) | Unsulfurized, carboxylate-containing additive | 60% |
| | Primary alkyl zinc dithiophosphate | 5% |
| | Phenol-type oxidation inhibitor | 5% |
| | Oil of lubricating viscosity | 30% |
| 8) | Unsulfurized, carboxylate-containing additive | 60% |
| | Alkenyl succinimide ashless dispersant | 5% |
| | Alkylated diphenylamine-type oxidation inhibitor | 10% |
| | Oil of lubricating viscosity | 25% |

-continued

| Other Additive Packages | | |
|---|---|---|
| 9) | Unsulfurized, carboxylate-containing additive | 55% |
| | Other additives | 25% |
| | Primary alkyl zinc dithiophosphate | |
| | Alkenyl succinic ester ashless dispersant | |
| | Phenol-type oxidation inhibitor | |
| | Alkylated diphenylamine-type oxidation inhibitor | |
| | Oil of lubricating viscosity | 30% |
| II. Motor Car Engine Oils | | |
| 1) | Unsulfurized, carboxylate-containing additive | 25% |
| | Alkenyl succinimide ashless dispersant | 35% |
| | Primary alkyl zinc dithiophosphate | 10% |
| | Oil of lubricating viscosity | 30% |
| 2) | Unsulfurized, carboxylate-containing additive | 20% |
| | Alkenyl succinimide ashless dispersant | 40% |
| | Secondary alkyl zinc dithiophosphate | 5% |
| | Dithiocarbamate type oxidation inhibitor | 5% |
| | Oil of lubricating viscosity | 30% |
| 3) | Unsulfurized, carboxylate-containing additive | 20% |
| | Alkenyl succinimide ashless dispersant | 35% |
| | Secondary alkyl zinc dithiophosphate | 5% |
| | Phenol type oxidation inhibitor | 5% |
| | Oil of lubricating viscosity | 35% |
| 4) | Unsulfurized, carboxylate-containing additive | 20% |
| | Alkenyl succinimide ashless dispersant | 30% |
| | Secondary alkyl zinc dithiophosphate | 5% |
| | Dithiocarbamate type anti-wear agent | 5% |
| | Oil of lubricating viscosity | 40% |
| 5) | Unsulfurized, carboxylate-containing additive | 20% |
| | Succinimide ashless dispersant | 30% |
| | Secondary alkyl zinc dithiophosphate | 5% |
| | Molybdenum-containing anti-wear agent | 5% |
| | Oil of lubricating viscosity | 40% |
| 6) | Unsulfurized, carboxylate-containing additive | 20% |
| | Alkenyl succinimide ashless dispersant | 30% |
| | Other additives | 10% |
| | Primary alkyl zinc dithiophosphate | |
| | Secondary alkyl zinc dithiophosphate | |
| | Alkylated diphenylamine-type oxidation inhibitor | |
| | Dithiocarbamate type anti-wear agent | |
| | Oil of lubricating viscosity | 40% |
| 7) | Unsulfurized, carboxylate-containing additive | 60% |
| | Other additives | 10% |
| | Phenol type oxidation inhibitor | |
| | Alkylated diphenylamine-type | |
| | Oxidation inhibitor | |
| | Dithiocarbamate type anti-wear agent | |
| | Demulsifier | |
| | Boron-containing friction modifier | |
| | Oil of lubricating viscosity | 30% |
| III. Hydraulic Oils | | |
| 1) | Unsulfurized, carboxylate-containing additive | 20% |
| | Primary alkyl zinc dithiophosphate | 50% |
| | Other additives | 25% |
| | Phenol type oxidation inhibitor | |
| | Phosphorus-containing extreme pressure agent | |
| | Triazol type corrosion inhibitor | |
| | Demulsifier | |
| | Nonionic anti-rust agent | |
| | Oil of lubricating viscosity | 5% |
| 2) | Unsulfurized, carboxylate-containing additive | 10% |
| | Primary alkyl zinc dithiophosphate | 40% |
| | Other additives | 47% |
| | Phenol type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 3% |
| 3) | Unsulfurized, carboxylate-containing additive | 10% |
| | Phosphorus-containing extreme pressure agent | 40% |
| | Phenol type oxidation inhibitor | 15% |

-continued

| Other Additive Packages | | |
|---|---|---|
| | Other additives | 25% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 10% |
| 4) | Unsulfurized, carboxylate-containing additive | 20% |
| | Phosphorus-containing extreme pressure agent | 30% |
| | Other additives | 45% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 5% |
| IV. Transmission Hydraulic Fluids | | |
| 1) | Unsulfurized, carboxylate-containing additive | 35% |
| | Primary alkyl zinc dithiophosphate | 20% |
| | Polyol type friction modifier | 20% |
| | Sulfur-containing extreme pressure agent | 5% |
| | Oil of lubricating viscosity | 20% |
| 2) | Unsulfurized, carboxylate-containing additive | 40% |
| | Primary alkyl zinc dithiophosphate | 15% |
| | Amide type friction modifier | 15% |
| | Sulfur-containing extreme pressure agent | 5% |
| | Oil of lubricating viscosity | 25% |
| 3) | Unsulfurized, carboxylate-containing additive | 30% |
| | Primary alkyl zinc dithiophosphate | 20% |
| | Other additives | 30% |
| | Alkenyl succinimide ashless dispersant | |
| | Amide type friction modifier | |
| | Ester type friction modifier | |
| | Phosphorus, Sulfur-containing extreme pressure agent | |
| | Oil of lubricating viscosity | 20% |
| 4) | Unsulfurized, carboxylate-containing additive | 35% |
| | Primary alkyl zinc dithiophosphate | 15% |
| | Other additives | 25% |
| | Polyol type friction modifier | |
| | Amide type friction modifier | |
| | Phosphorus, Sulfur-containing extreme pressure agent | |
| | Oil of lubricating viscosity | 25% |

Preferably, the weight ratio between the lubricating agents having an alkyl group from about 20 to 160 carbon atoms and the lubricating agents having an alkyl group from about 9 to 20 carbon atoms, is at least 20:80, in particular at least 30:70.

The lubricating oil composition of the present invention can moreover comprise an alkaline or alkaline-earth metal carbonate, preferably calcium carbonate.

The alkaline-earth metal carbonate content can be from about 5 wt % to 25 wt %, preferably from about 10 wt % to 20 wt %, with respect to the total weight of the lubricating composition.

According to another advantageous aspect of the present invention, the lubricating agent of the alkaline-earth metal alkylarylsulfonate type, at least one lubricating agent under (A) to (B) and the alkaline carbonate or optionally the alkaline-earth metal carbonate, are presented in the form of micelles.

Process for the Preparation of the Lubricating Oil Composition

In yet another aspect, the present invention relates to a process for the preparation of a lubricating oil composition as described above. This process comprises mixing a base oil of lubricating viscosity and the lubricating oil additive of the present invention.

As an example, the lubricating oil composition may be obtained by a process as follows.

(A) neutralizing a mixture of alkyl aromatic sulfonic acids of an alkaline-earth metal, (B) adding to the mixture of (A) at least one compound selected from the group consisting of:

(i) an alkyl hydroxybenzoic acid or the alkaline metal or alkaline-earth metal salts thereof, (ii) a carboxylated detergent-dispersant additive obtained by:

(a) neutralizing alkylphenols using an alkaline-earth metal base forming an intermediate product; and (b) carboxylating the intermediate product using carbon dioxide so that at least 20 mole % of the original alkylphenol starting material has been converted to alkaline-earth metal single aromatic-ring hydrocarbyl salicylate; and (iii) a sulfurized or non-sulfurized alkylphenol or the alkaline metal or alkaline-earth metal salt thereof, wherein the alkyl group in each of (B)(i) to (B)(iii) is independently a linear, branched or mixture of linear and branched alkyl group having from about 20 to 160 carbon atoms, or from about 9 to 20 carbon atoms, or a mixture of both.

(C) carbonating the mixture of (B) using carbon dioxide;

(D) adding a base oil of lubricating viscosity, and (E) recovering the resulting lubricating oil composition.

In stage (A), a mono- or polyhydroxylated alcohol can be used. Methanol and glycol are preferred. The alcohol content by weight can be from about 2% to 15%, preferably from about 4% to 10% with respect to the weight of the mixture formed in stage (A). A solvent such as xylene can also be added to this mixture.

Stage (A) is usually carried out at a temperature between 20° C. and 100° C.

The carbonation in stage (C) is carried out using carbon dioxide added at atmospheric pressure or under a pressure generally from about 1 bar ($10^5$ Pa) to 6.5 bars ($10^5$ Pa), preferably from about 1 ($10^5$ Pa) to 3.5 bars ($10^5$ Pa).

Stage (C) is usually carried out at a temperature from about 20° C. to 60° C., preferably from about 25° C. to 48° C.

Between stage (D) and stage (E), elimination of the solvents as well as elimination of the sediments is preferably carried out, for example by filtration or centrifugation.

The lubricating oil additive of the present invention makes it possible to increase the high temperature stability of the lubricating oil composition as well as reducing deposits and providing improved dispersing power to the lubricating oil composition.

The components of the lubricating oil composition can be blended in any order and can be blended as combinations of components. The lubricating oil composition produced by blending the above components might be a slightly different composition than the initial mixture because the components may interact.

The lubricating compositions according to the invention can more particularly be used for the lubrication of engines, such as diesel or gasoline engines, whether these engines are two stroke or four stroke. They are particularly suitable for land vehicle engines (tractors, trucks, cars) and, preferably, marine engines, such as two-stroke crosshead marine (Marine Cylinder Lubricant) engines or so-called trunk piston engine oil (TPEO) engines, i.e. semi-rapid four-stroke engines, operating with heavy fuel. Additionally, the present lubricating oil composition may be used to lubricate hydraulic systems by contacting the hydraulic system with the lubricating oil composition of the present invention.

Other Additive Components

The following additive components are examples of components that can be favorably employed in combination with the lubricating additive of the present invention. These examples of additives are provided to illustrate the present invention, but they are not intended to limit it.

(A) Ashless dispersants: Alkenyl succinimides, alkenyl succinimides modified with other organic compounds, and alkenyl succinimides modified with boric acid, alkenyl succinic ester.

(B) Oxidation inhibitors:

1) Phenol type phenolic) oxidation inhibitors: 4,4'-methylenebis (2,6-di-tert-butyl phenol), 4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis (3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl4-methylphenol, 2,6-di-tert-butyl4-ethylphenol, 2,4-dimethyl-6-tert-butyl-phenol, 2,6-di-tert-α-dimethylamino-p-cresol, 2,6-di-tert-4 (N.N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyidithiocarbamate).

(C) Rust inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(D) Demulsifiers: addition product of alkylphenol and ethyleneoxide, poloxyethylene alkyl ether, and polyoxyethylene sorbitane ester.

(E) Extreme pressure agents (EP agents): zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(F) Friction modifiers: fatty alcohol, fatty acid, amine, borated ester, and other esters (G) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound (H) Viscosity Index improvers: polymethacrylate type polymers, ethylene-propylene copolymers, styrene-isoprene copolymers, hydrated styrene-isoprene copolymers, polyisobutylene, and dispersant type viscosity index improvers.

(I) Pour point depressants: polymethyl methacrylate.

(K) Foam Inhibitors: alkyl methacrylate polymers and dimethyl silicone polymers.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Unless otherwise specified, all percentages are in weight percent.

Example 1

Preparation of a Lubricating Oil Additive Composition Comprising a Calcium Alkylcarboxylate and an Overbased Calcium Alkylarylsulfonate 1. Premixture 1180.8 g of xylene (1) and 129.8 g of methanol (1), then 157 g of calcium hydroxide was introduced into a four-necked reactor, agitated and being able to be placed under vacuum.

The premixture thus obtained was placed under agitation at 350 rpm.

2. Neutralization 249.4 g of an alkylarylsulfonic acid wherein the alkyl chain has from about 20 to 28 carbon atoms and of which the molar percentage of arylsulfonic group fixed in position 1 or 2 of the alkyl chain is approximately 10% (hereafter called "alkylarylsulfonic acid 10" in Table 1), marketed by CHEVRON ORONITE S.A., was introduced into the premixture obtained in stage 1 above. The acid pre-heated to 50° C. was added over 15 minutes using an ampoule whilst limiting the temperature to around 30° C. during the addition of the acid. The reaction mixture was left to homogenize for 15 minutes, until the temperature was around 25° C.

3. Addition of the Carboxylate Detergent-Dispersant Additive 62.3 g of the carboxylate detergent-dispersant additive (Batch procedure of this carboxylate is described in Example 1 of U.S. Pat. No. 6,162,770), having the following weight composition:

29% calcium alkylcarboxylate,
16% calcium alkylphenate,
55% alkylphenol was introduced over 20 minutes into the reactor.

The carboxylate detergent-dispersant additive was prepared from a mixture of 50% alkylphenols with branched alkyl chains having 12 carbon atoms and of molar mass=272 and 50% alkylphenols prepared from normal alpha olefins with a linear alkyl chain having from about 20 to 28 carbon atoms and of molar mass=430.

The mixture was homogenized for 10 minutes at 25° C.

4. Carbonation 35 g of carbon dioxide ($CO_2$) (1) was introduced over 40 minutes at a temperature of from about 25° C. to 34° C. into the reactor, then milk of lime comprising 389.2 g xylene (2), 129.8 g methanol and 157 g calcium hydroxide was introduced.

103.9 g of $CO_2$ (2) was then introduced into the reactor over 72 minutes at a temperature of from about 32° C. to 43° C., then a second milk of lime comprising 279.6 g (3) of xylene and 80.4 g calcium hydroxide was introduced.

24.3 g of $CO_2$ (3) was then introduced into the reactor over 20 minutes at a temperature of from about 40° C. to 42° C., followed by 19.4 g of $CO_2$ (4) was introduced over 37 minutes at a temperature of 40° C.

5. Predistillation, Centrifugation and Final Distillation

The mixture contained within the reactor was taken in stages to a temperature comprised between 40° C. and 128° C. over 2 hours and 5 minutes, by adding 22.3 g of water during the rise in temperature. 311.9 g of oil at a dilution of 600N, then 470 g of xylene was then added. The mixture was centrifuged on an Alfa Laval Gyrotester™ and heated to approximately 204° C. to eliminate the xylene whilst under partial vacuum at $4.10^3$ Pa for 10 minutes.

Examples 2 to 6 describe the preparation of the lubricating oil additive compositions of the present invention comprising an overbased calcium alkylarylsulfonate wherein the alkyl group has from about 20 to 28 carbon atoms.

Example 2

The composition is the same as that of Example 1, but using an alkylarylsulfonic acid having an alkyl group having from about 20 to 28 carbon atoms and the molar percentage of arylsulfonic group fixed in position 1 or 2 of the alkyl chain is between 13 and 30% (hereafter called "alkylarylsulfonic acid 13-30" in Table 1).

Example 3

The composition is the same as that of Example 1, but using, instead of the carboxylate detergent-dispersant additive defined in Example 1, alkylphenols prepared from mixtures of linear alpha olefins ($C_{20}$-$C_{28}$ alpha olefins from Chevron Phillips Chemical Company) and branched olefins having 12 carbon atoms (propylene tetramer).

Example 4

The composition is the same as that of Example 1, but using, instead of the carboxylate detergent-dispersant additive defined in Example 1, a calcium alkylphenate prepared from a mixture of linear alpha olefins ($C_{20}$-$C_{28}$ alpha olefins from Chevron Phillips Chemical Company) and branched olefins having 12 carbon atoms (propylene tetramer).

Example 5

The composition is the same as that of Example 2, but using, instead of the carboxylate detergent-dispersant additive defined in Example 1, alkylphenols prepared from a mixture of linear alpha olefins ($C_{20}$-$C_{28}$ alpha olefins from Chevron Phillips Chemical Company) and branched olefins having 12 carbon atoms (called propylene tetramer).

Example 6

The composition is the same as that of Example 2, but using, instead of the carboxylate detergent-dispersant additive defined in Example 1, a calcium alkylphenate prepared from a mixture of linear alpha olefins ($C_{20}$-$C_{28}$ alpha olefins from the Chevron Phillips Chemical Company) and branched olefins having 12 carbon atoms (called propylene tetramer).

The reagent loads used to carry out these tests, as well as the contents of the main constituents of the final resulting product, are indicated in Table 1 as well as the loads used for Comparative Examples A and B (below) in the performance tests, and the results of analysis of the products obtained are indicated in Table 2, hereafter.

Comparative Example A

Comparative Example A was prepared analogously to Example 1 except no carboxylate detergent-dispersant was added. The surfactant originates solely from sulfonic acid ("alkylarylsulfonic acid 10").

Comparative Example B

Comparative Example B was prepared analogously to Example 2 except no carboxylate detergent-dispersant was added. The surfactant originates solely from sulfonic acid ("alkylarylsulfonic acid 13-30").

TABLE 1

| | | Examples | | | | | | Comparative Examples | |
|---|---|---|---|---|---|---|---|---|---|
| Load | | 1 | 2 | 3 | 4 | 5 | 6 | A | B |
| Overbasing phase | | | | | | | | | |
| Xylene (1) | (g) | 1180.8 | 1180.8 | 1180.8 | 1180.8 | 1180.8 | 1180.8 | 1180.8 | 1180.8 |
| Xylene (2) | (g) | 389.2 | 389.2 | 389.2 | 389.2 | 389.2 | 389.2 | 389.2 | 389.2 |
| Xylene (3) | (g) | 279.6 | 279.6 | 279.6 | 279.6 | 279.6 | 279.6 | 279.6 | 279.6 |
| Xylene (4) | (g) | 470 | 470 | 470 | 470 | 470 | 470 | 470 | 470 |
| Methanol (1) | (g) | 129.8 | 129.8 | 129.8 | 129.8 | 129.8 | 129.8 | 129.8 | 129.8 |
| Methanol (2) | (g) | 129.8 | 129.8 | 129.8 | 129.8 | 129.8 | 129.8 | 129.8 | 129.8 |
| Calcium hydroxide (1) | (g) | 157 | 157 | 157 | 157 | 157 | 157 | 157 | 157 |
| Calcium hydroxide (2) | (g) | 157 | 157 | 157 | 157 | 157 | 157 | 157 | 157 |
| Calcium hydroxide (3) | (g) | 80.4 | 80.4 | 80.4 | 80.4 | 80.4 | 80.4 | 80.4 | 80.4 |
| $CO_2$ (1) | (g) | 35 | 35 | 35 | 35 | 35 | 35 | 35 | 35 |
| $CO_2$ (2) | (g) | 103.9 | 103.9 | 103.9 | 103.9 | 103.9 | 103.9 | 103.9 | 103.9 |
| $CO_2$ (3) | (g) | 24.3 | 24.3 | 24.3 | 24.3 | 24.3 | 24.3 | 24.3 | 24.3 |
| $CO_2$ (4) | (g) | 19.4 | 19.4 | 19.4 | 19.4 | 19.4 | 19.4 | 19.4 | 19.4 |
| Carboxylate Detergent-Dispersant Additive | (g) | 62.3 | 62.3 | | | | | | |
| Calcium alkylphenates | (g) | | | | 40 | | 40 | | |
| Alkylphenols | (g) | | | 62.3 | | 62.3 | | | |
| Alkylarylsulfonic acid 10 | (g) | 249.4 | | 249.4 | 249.4 | | | 249.4 | |
| Alkylarylsulfonic acid 13-30 | (g) | | 253.5 | | | 253.5 | 253.5 | | 253.5 |
| Dilution oil (600N) | (g) | 311.9 | 307.8 | 311.9 | 311.9 | 307.8 | 307.8 | 374.2 | 370.1 |

TABLE 1-continued

| Load | | Examples 1 | 2 | 3 | 4 | 5 | 6 | Comparative Examples A | B |
|---|---|---|---|---|---|---|---|---|---|
| $H_2O$ (100%) | (g) | 22.3 | 22.3 | 22.3 | 22.3 | 22.3 | 22.3 | 22.3 | 22.3 |
| Quantity manufactured | (g) | 1104.7 | 1104.7 | 1104.7 | 1104.7 | 1104.7 | 1104.7 | 1104.7 | 1104.7 |
| Total surfactant | | 237.7 | 241.2 | 212.0 | 241.5 | 215.5 | 245 | 212 | 215.5 |
| "Phenol"/Total surfactant (%) | | 3.9 | 3.9 | 0 | 12.2 | 0 | 12 | 0 | 12 |
| "Phenol" + "hydroxybenzoic acid"/Total surfactant (%) | | 10.8 | 10.6 | 0 | 12.2 | 0 | 12 | 0 | 0 |
| % Total surfactant | | 21.5 | 21.8 | 19.2 | 21.9 | 19.5 | 22.2 | 19.2 | 19.5 |
| TBN/% Total surfactant | | 22.7 | 22.7 | 25.1 | 22.4 | 25 | 22.2 | 25.2 | 24.9 |

Example of calculation of:

1. Phenol/Total Surfactant" (%)

2. $$\frac{\text{"Phenol"} + \text{"Hydroxybenzoicacid"}}{\text{Total Surfactant}} \ (\%)$$

3. % Total Surfactant

4. TBN/% Surfactant

Composition of Carboxylate Detergent-Dispersant Additive:

unreacted alkylphenol=55%

Ca alkylphenate=16%

Ca alkylcarboxylate=29%

Alkylphenol molecular weight=330

For the same alkylphenol: alkylphenol/Ca alkylphenate=0.945

Hydroxybenzoic acid molecular weight=375

For the same hydroxybenzoic acid: hydroxybenzoic acid/Ca hydroxybenzoate=0.91

For 100 g of carboxylate detergent-dispersant additive, there is as "surfactant" as described herein:

Phenol=15 g

Hydroxybenzoic acid=26.4 g

Composition of Alkyl Sulfonic Acid is:

5% unsulfonated alkylate

10% diluent oil

85% surfactant

Composition of Potassium Alkyl Hydroxybenzoate:

Unreacted alkylphenol: 7%

Potassium alkylphenate: 8.20%

Diluent oil: 30%

Potassium hydroxybenzoate: 54.80%

Weight ratio between the salified and non-salified components are:

alkylphenol/K alkylphenate=0.92 hydroxybenzoic/K hydroxybenzoate=0.91

So for 100 g of K alkyl hydroxybenzoate, there are as surfactant as described herein: phenol=7.5 g and hydroxybenzoic acid=50 g Composition of Ca Alkylphenate:

Unreacted alkylphenol=22%

Ca alkylphenate=78%

So for 100 g of Ca alkylphenate, there is as surfactant as described herein: Phenol=73.7 g (78×0.945)

For Example 1:

Calculation of Total Surfactant 62.3×0.15=9.34 g(phenol)

62.3×0.264=16.45 g(hydroxybenzoic acid)

249.4×0.85=212 sulfonic acid

Total surfactant=9.34+16.45+212=237.7

$$\frac{\text{Phenol}}{\text{Total Surfactant}} \times 100 = 3.9\%$$

$$\frac{\text{Phenol} + \text{Hydroxybenzoic acid}}{\text{Total Surfactant}} \times 100 = 10.8\%$$

$$\text{Total Surfactant (\%)} = \frac{237.7}{1104.7} \times 100 = 21.9\%$$

TBN/% Total Surfactant=489/21.7=22.7%

TABLE 2

| Analyses | | Examples 1 | 2 | 3 | 4 | 5 | 6 | Comparative Examples A | B |
|---|---|---|---|---|---|---|---|---|---|
| Calcium | (% wt) | 18.23 | 18.5 | 18.02 | 18.3 | 18.1 | 18.4 | 18.05 | 18.1 |
| Sulfur | (% wt) | 1.6 | 1.55 | 1.59 | 1.6 | 1.62 | 1.61 | 1.61 | 1.62 |
| Appearance in the oil | | 1/0 | 1/0 | 1/0 | 1/0 | 1/0 | 1/0 | 1/0 | 1/0 |
| TBN (ASTM D 2896) | (mgKOH/g) | 489 | 496 | 482 | 490 | 487 | 493 | 483 | 485 |
| % CaS (ASTM D 3712) Calcium Sulfonate | (% wt) | 0.82 | 0.82 | 0.82 | 0.82 | 0.82 | 0.82 | 0.82 | 0.82 |
| Viscosity at 100° C. (as it is) (ASTM D 445) | ($mm^2/s$ | 248 | 403 | 260 | 260 | 430 | 429 | 230 | 350 |
| Crude Sediment (ASTM D 2273) | (% v/v) | 2.8 | 1.6 | 2 | 2 | 2 | 2 | 2 | 2 |
| Final Sediment (ASTM D 2273) | (% v/v) | 0.02 | 0.02 | 0.02 | 0.02 | 0.12 | 0.2 | 0.4 | 0.4 |

Performance Testing and Results

The performance of the lubricating oil compositions was tested by using the following tests:

1. Hot Tube Test (I) Main Objective of the Test

The "Hot Tube Test" was designed to evaluate the detergency and the thermal stability of a lubricating oil composition by grading the coloring of a deposit formed in glass tubes heated to a high temperature.

(II) Implementation of the Test

A glass tube in which the oil circulates under a flow of air was placed in an oven heated to a high temperature. A lacquer appears on the wall of the tube because of the alteration of the lubricating oil additive.

The lacquer was graded by comparison with a reference color chart, ranging from 0 (black) to 10 (clean). When the detergent power is particularly poor, the glass tube blocks and becomes black (CLOGGED).

| (III) Parameters of Implementation of the Test | |
|---|---|
| Duration of the test | 16 hrs |
| Sample of lubricating oil | 5 $cm^3$ |
| Flow of oil | 0.3 $cm^3$/hr |
| Flow of air | 10 $cm^3$/hr |
| Temperature: | 310° C. |

(IV) Formulations Tested

Six samples (1 to 6) of lubricating oil compositions containing the products of Examples 1 to 6 were prepared:

A 100 g mixture was prepared in a 250 ml beaker, containing the following components: the product to be tested in such a quantity that the TBN provided by this product was equal to 70 (or 14 g for a product having a TBN equal to 500). The mixture was completed to 100 g by a 600N base oil (from TOTAL FRANCE).

Comparative Examples A and B used were formulated in the same manner.

2. Phenate Compatibility Test (I) Main Objective of the Test

To evaluate the stability in storage of the lubricating compositions.

(II) Implementation of the Test

A mixture of 100 g was prepared in a 250 ml beaker, containing the following products:

a phenate of TBN 250 in such a quantity that the TBN provided by the phenate in the 100 g mixture was equal to 50 (or 20 g of the phenate having a TBN of 250).

product to be tested in the 100 g mixture in such quantity that the TBN provided by the product was equal to 20 (or 4 g of the product having a TBN of 500).

35 g dilution oil, 150 bright stock (from the Idemitsu Kosan Company).

The mixture was completed to 100 g by adding 500N oil (from the Idemitsu Kosan Company), then mixed over 30 minutes at 65° C. The mixture is transferred into a centrifuge ampoule which is placed in the oven for 3 days at 80° C., then centrifuged for one hour at 4500 rpm.

The percentage of sediment was then read (the centrifuge ampoule was graduated in percentages). If this percentage was lower than 0.05%: the result was good.

(III) Formulations Tested

The compositions of Examples 1 to 6, as well as Comparative Examples A and B, were tested.

3. The Performance Tests Results

The results of the performance tests are shown in Table 3 and 4.

These results show that the compositions according to the present invention (Examples 1 to 6), which include the combination of a mixture of alkyl aromatic sulfonates of alkaline-earth metals with another lubricating agent present a detergent credit as well as a thermal stability greater than formulations not comprising this combination (Comparative Examples A and B).

TABLE 3

| | Examples | | | | | | Comparative Examples | |
|---|---|---|---|---|---|---|---|---|
| Formulation | 1 | 2 | 3 | 4 | 5 | 6 | A | B |
| Calcium phenate C 12 TBN 250[1] | 19.45% | 19.45% | 19.45% | 19.45% | 19.45% | 19.45% | 19.45% | 19.45% |
| Quantity of product of invention[2] | 4.08% | 4.03% | 4.15% | 4.08% | 4.11% | 4.06% | | |
| Quantity comparative examples[2] | | | | | | | 4.14% | 4.12% |
| 150N bright stock (Idemitsu) | 35% | 35% | 35% | 35% | 35% | 35% | 35% | 35% |
| 500N oil (Idemitsu) | 41.47% | 41.52% | 41.4% | 41.47% | 41.44% | 41.49% | 41.41% | 41.43% |
| Compatibility (% Sediment) | 0.05 | 0.002 | 0.05 | 0.05 | 0.002 | 0.002 | 0.5 | 0.002 |

[1]Corresponding to TBN of 50

[2]Corresponding to TBN of 20

TABLE 4

| | Examples | | | | | | Comparative Examples | |
|---|---|---|---|---|---|---|---|---|
| Formulation | 1 | 2 | 3 | 4 | 5 | 6 | A | B |
| Quantity of product of invention[1] | 14.31% | 14.11% | 14.52% | 12.28% | 14.37% | 14.2% | | |
| Quantity comparative examples[1] | | | | | | | 14.49% | 14.43% |
| 600N base oil | 85.69% | 85.89% | 85.48% | 87.72% | 85.63% | 85.8% | 85.51% | 85.57% |
| Hot Tube (310° C.) | 9 | 9 | 9 | 9 | 9 | 9 | clogged | clogged |

[1]Corresponding to TBN of 70

Example 7

Preparation of a Lubricating Oil Additive Composition Comprising a Calcium Alkylcarboxylate and an Overbased Calcium Alkylarylsulfonate Note in Examples 1 through 6 of the present invention and in Comparative Examples A and B low soap and very high TBN (400-500) were obtained (so the ratio TBN/% Total Surfactant was typically high around 20-26). In Examples 7 and 8 and Comparative Example C, a lower TBN (around 300) was targeted. So, the ratio TBN/% Total Surfactant was typically intermediate, around 10.

1. Premixture 1042.4 g of xylene and 217.7 g of methanol, then 226.8 g of calcium hydroxide were introduced into a four-necked reactor, agitated and being able to be placed under vacuum. The premixture thus obtained was placed under agitation at 350 rpm.

2. Neutralization 303.8 g of an alkylarylsulfonic acid having an alkyl chain having from about 20 to 28 carbon atoms and the molar percentage of arylsulfonic group fixed in position 1 or 2 of the alkyl chain is between 13% and 30% (hereafter called "alkylarylsulfonic acid 13-30" in Table 5), marketed by CHEVRON ORONITE S.A., was introduced into the premixture obtained in stage 1 above.

The acid pre-heated to 50° C. was added using an ampoule over 20 minutes whilst limiting the temperature to around 30° C. for the addition of the acid. The mixture was allowed to homogenize for 15 minutes until the temperature was around 25° C.

3. Addition of the Calcium Alkylcarboxylate 279.8 g of the carboxylate detergent-dispersant additive described in Example 1 above was introduced into the reactor over 20 minutes followed by homogenizing for 10 minutes at 25° C.

4. Carbonation 31.7 g of $CO_2$ (1) was introduced into the reactor over 30 minutes at a temperature of 25° C. to 27° C. then 65.3 g of $CO_2$ (2) was introduced over 78 minutes at a temperature of 27° C. to 33° C. Milk of lime was then introduced, comprising 260.7 g of xylene; 61.2 g of methanol and 63.7 g of calcium hydroxide. 28.2 g of $CO_2$ (3) was then introduced over 54 minutes at a temperature of 32° C. to 37° C.

5. Predistillation, Centrifugation and Final Distillation

The mixture contained in the reactor was taken in stages to a temperature comprised between 37° C. and 128° C. over 2 hours and 10 minutes. 349.2 g of 600N dilution oil, then 259 g of xylene was then added. The mixture was centrifuged on an Alfa Laval Gyrotester followed by heating to approximately 204° C. to eliminate the xylene whilst under partial vacuum at $4.10^3$ Pa for 10 minutes.

Example 8

Preparation of the Lubricating Oil Additive Composition According to the Present Invention Comprising an Overbased Calcium Alkylarylsulfonate Example 8 was the same as that of Example 7, but using a potassium hydroxybenzoate instead of the carboxylate detergent-dispersant additive.

Comparative Example C

Comparative Example C was prepared analogously to Example 7 except no carboxylate detergent-dispersant additive was used. Alkylarylsulfonic acid was the only surfactant.

Table 5 hereafter summarizes the loads used for the compositions in Examples 7 and 8 and Comparative Example C in the performance test.

The results of analysis of these compositions are indicated in Table 6 hereafter.

TABLE 5

| Load | | Examples 7 | Examples 8 | Comparative Examples C |
|---|---|---|---|---|
| Xylene (1) | (g) | 1042.4 | 1042.4 | 1042.4 |
| Xylene (2) | (g) | 260.7 | 260.7 | 260.7 |
| Xylene (3) | (g) | 259 | 259 | 259 |
| Methanol (1) | (g) | 217.7 | 217.7 | 217.7 |
| Methanol (2) | (g) | 61.2 | 61.2 | 61.2 |
| Calcium hydroxide (1) | (g) | 226.8 | 226.8 | 226.8 |
| Calcium hydroxide (2) | (g) | 63.7 | 63.7 | 63.7 |
| $CO_2$ (1) | (g) | 31.7 | 31.7 | 31.7 |
| $CO_2$ (2) | (g) | 65.3 | 65.3 | 65.3 |
| $CO_2$ (3) | (g) | 28.2 | 28.2 | 28.2 |
| Carboxylate Detergent-Dispersant Additive | (g) | 279.8 | | |
| Potassium hydroxybenzoate | (g) | | 279.8 | |
| Alkylarylsulfonic acid 13-30 | (g) | 303.8 | 303.8 | 434 |
| Dilution oil (600N) | (g) | 349.2 | 349.2 | 498.8 |
| Quantity manufactured | (g) | 1277.8 | 1277.8 | 1277.8 |
| Total surfactant | | 374.1 | 419.3 | 368.9 |
| "Phenol"/Total surfactant (%) | | 11.2 | 5 | 0 |
| "Phenol" + "hydroxybenzoic acid"/Total surfactant (%) | | 31 | 38.4 | 0 |
| % Total surfactant | | 29.3 | 32.8 | 28.9 |
| TBN/% Total surfactant | | 10.75 | 9.4 | 9.9 |

TABLE 6

| Analyses | | Examples 7 | Examples 8 | Comparative Example C |
|---|---|---|---|---|
| Potassium | (% wt) | 0 | 1.01 | 0 |
| Calcium | (% wt) | 12.13 | 11.55 | 11.45 |
| Sulfur | (% wt) | 1.63 | 1.63 | 2.32 |
| Appearance in the oil | | 1/0 | 1/0 | 1/0 |
| TBN D 2896 | (mgKOH/g) | 315 | 308 | 287 |
| % CaS (ASTM D 3712) Calcium sulfonate | (% wt) | 0.87 | 0.87 | 1.24 |
| Viscosity at 100° C. (as it is) ASTM D 445 | ($mm^2/s$) | 180 | 131 | 70 |
| Crude sediment (ASTM D 2273) | (% v/v) | 3 | 2 | 2.2 |
| Final sediment (ASTM D 2273) | (% v/v) | 0.02 | 0.02 | 0.4 |

Performance Results

The performance of the lubricating compositions of Examples 7 and 8 as well as those of Comparative Example C were tested using the "Hot Tube Test" used for Examples 1 to 6, as well as the Storage Stability Test and the "Microcracking" Test according to the protocol below:

1. Storage Stability Test (I) Main Objective of the Test:

To evaluate the stability in storage of the lubricating oil compositions.

(II) Implementation of the Test:

The compositions were stored in tubes at 80° C. for one month.

The appearance of the sediment (thickness at the bottom of the tube) of the compositions was classified by comparison with references.

The clearer the product, and the less it forms sediment, the better the composition.

(III) Parameters for Implementation of the Test:

| | |
|---|---|
| Duration of test: | one month |
| Oven temperature: | 80° C. |
| Appearance: | bright (1), light cloud (2), moderate cloud (3) |
| Sediment: | absent (0), light (1), average (2), considerable (3) 1/0 means product clear/ absence of sediment |

(IV) Formulations Tested

The compositions of Examples 7 and 8 as well as Comparative Example C were tested for storage stability.

2. Microcracking Test (I) Main Objective of the Test

To evaluate the tendency of an oil to form deposits at high temperature and to evaluate its detergent credit.

(II) Implementation of the Test

The oil sample was placed in an aluminum trough heated at both ends and in which a controlled temperature gradient was established. A deposit forms on the wall of the trough at a certain point in the temperature gradient.

The temperature at which deposits started forming was noted; the higher this temperature was, the better the oil.

| | |
|---|---|
| Duration of the test: | 90 min |
| Oil sample: | 1 $cm^3$ |
| Temperature gradient: | hot point 280° C. cold point 230° C. |

3. Performance Tests Results

The results are given in Table 7 below.

TABLE 7

| | Examples | | Comparative Example |
|---|---|---|---|
| Formulation | 7 | 8 | C |
| Polybutene bissuccinimide | 1.4% | 1.4% | 1.4% |
| Zinc dithiophosphate | 0.66% | 0.66% | 0.66% |
| Quantity of product of invention[1] | 12.69% | 12.98% | |
| Quantity of comparative example[1] | | | 13.93% |
| Anti foam agent | 0.004% | 0.004% | 0.004% |
| 600N base oil | 85.24% | 84.95% | 84.01% |
| Microcracking Test | 242° C. | 245° C. | <230° C. |
| Storage stability (one month 80° C.) | 1/0 | 1/0 | 1/0 |
| Hot Tube (320° C.) | 9 | 9 | Clogged |

[1]Corresponding to TBN of 40

With regard to Comparative Example C, the whole periphery of the aluminum trough was full of deposit, which indicates that the temperature at which the deposit started forming was necessarily below 230° C.

The results in Table 7 show that the compositions according to the present invention (Examples 7 and 8) have properties superior to that of Comparative Example C in regard to the thermal stability and the detergent credit.

Example 9

Process for the Preparation of a Potassium $C_{20}$-$C_{28}$ Alkylhydroxylbenzoate in Combination with an Overbased Calcium $C_{20}$-$C_{24}$ Alkylarylsulfonate In Examples 9 and 10, TBN is lower than in the previous Examples 1 through 8 and the sulfonic acid surfactant is present in minor amounts versus hydroxybenzoic acid (which is the major surfactant).

1. Premixing 473.8 g of xylene was introduced into a four-neck reactor with stirring at 350 rpm under vacuum, followed by a lime slurry constituted by 568.6 g of xylene, 92.5 g of methanol (1) and 96.3 g of lime (1).

Total xylene (1)=1042.4 g

2. Neutralization of Alkylarylsulfonic Acid 120 g of alkylarylsulfonic acid, wherein the alkyl chain is a $C_{20}$-$C_{24}$ linear alpha olefin marketed by Chevron Phillips Chemical Company (CPC) under the name Alpha Olefin $C_{20}$-$C_{24}$ was introduced into the above premixture obtained. The reaction medium was preheated to 50° C. over 20 minutes then left to homogenize for 15 minutes, until the temperature reached approximately 25° C.

3. Preparation and Addition of Potassium Alkylhydroxybenzoate

The process for the preparation of the potassium alkylhydroxybenzoate is described herein as follows.

A. Neutralization Step:

1200 g of alkylphenol wherein the alkyl group is derived from a mixture of $C_{20}$-$C_{28}$ linear alpha olefins, available from Chevron Phillips Chemical Company (CPC) and 632 g of ethylhexanol were charged with stirring into a four-necked reactor under vacuum.

The reaction mixture was heated from ambient temperature to 95° C. over 25 minutes under $10^5$ Pa (absolute pressure), then 311.8 g of an aqueous solution with 50 wt % of potassium hydroxide was introduced. The mixture was then taken to a temperature of 195° C. over 3 hours 30 minutes. As purity of KOH is 86.4 wt % and water: 50 wt %; effective quantity of KOH is: 311.8×0.5×0.864=134.7 g [which corresponds to a CMR (KOH/alkylphenol)=0.9]. Heating was continued progressively until reflex temperature was reached at 210° C., at which the temperature was maintained for 2 hours.

The temperature was then allowed to drop to 195° C. while reducing the vacuum to $4\times10^3$ Pa in order to distill the solvents. This temperature and pressure was maintained for 30 minutes with continued stirring at 600 rpm.

At the end of the distillation operation, 554.2 g of a 100N dilution oil, having a viscosity of 100 SUS at 37.8° C., was slowly added. When the temperature reached 170° C., the vacuum was discontinued with nitrogen purging while continuing to add dilution oil.

B. Carboxylation Step:

The mixture resulting from the neutralization step described above was introduced into a stainless steel reactor with stirring under vacuum pressure.

Carbon dioxide under a pressure of $3.5\times10^5$ Pa was then introduced into the reactor at a temperature of 125° C. to 130° C. over 6 hours. The potassium alkylhydroxybenzoate (alkylsalicylate) was recovered having a $C_{20}$-$C_{28}$ alkyl chain along with unreacted alkylphenol and potassium alkylphenate.

720 g of the potassium $C_{20}$-$C_{28}$ alkylhydroxybenzoate was introduced into the reactor over 20 minutes.

4. Carbonation 43.7 g (1) of carbon dioxide was introduced into the reactor over 90 minutes, at a temperature of 30° C. to 40° C., then a lime slurry containing 260.7 g of xylene (2), 24.4 g of methanol (2) and 25 g of calcium hydroxide (2), was introduced into the reactor.

13.1 g (2) of carbon dioxide was then introduced into the reactor over 45 minutes at a temperature of 35° C. to 43° C.

5. Pre-Distillation, Centrifugation and Final Distillation

The temperature of the mixture contained in the reactor was increased to between 110° C. to 132° C. 181.9 g of 600N dilution oil and 259 g of xylene were added successively. Then, another 181.9 g of 600N oil and 259 g of xylene (3) were again successively added. The resulting mixture was centrifuged on an Alfa Laval Gyrotester™ and heated to approximately 200° C. in order to eliminate the xylene while under partial vacuum at $4\times10^3$ Pa for 10 minutes.

Table 8 hereafter summarizes the loads used in order to form the combination of the potassium alkylhydroxybenzoate (alkylsalicylate) and the overbased calcium alkylarylsulfonate. The analysis results of this combination are shown in Table 8.

Example 10

Process for the Preparation of a Mixture of Potassium $C_{20}$-$C_{28}$ Alkylhydroxybenzoate in Combination with an Overbased Calcium Sulfonate Example 10 was prepared as in Example 9 except the starting alkylphenols used in this example were prepared from a 50/50 mixture (by weight) of a linear $C_{20}$-$C_{28}$ alpha olefin mixture, available from Chevron Phillips Chemical Company (CPC), and a $C_{20}$-$C_{28}$ linear alpha olefin mixture, available from British Petroleum Company (BP).

Comparative Example D

In this example, the product of the invention was replaced by a high overbased calcium alkylsulfonate. Sulfonic acid is the only surfactant.

Comparative Example E

In this example, the product of the invention was replaced by a high overbased calcium alkylsulfonate and a commercial salicylate.

Tables 8 and 9 provide a summary of loads and analyses of results.

TABLE 8

| Loads | | Examples 9 | Examples 10 |
|---|---|---|---|
| Linear alkylphenols | | | |
| CPC (C20-C28 olefin derivatives) | % | 100% | 50% |
| BP (C20-C28 olefin derivatives) | % | — | 50% |
| Molar ratio KOH/alkylphenols | | 0.9 | 0.9 |

TABLE 8-continued

| Loads | | Examples 9 | Examples 10 |
|---|---|---|---|
| Lime (1) | (g) | 96.3 | 96.3 |
| Lime (2) | (g) | 25 | 25 |
| Methanol (1) | (g) | 92.5 | 92.5 |
| Methanol (2) | (g) | 24.4 | 24.4 |
| Xylene (1) (Premixing) | (g) | 1042.4 | 1042.4 |
| Xylene (2) | (g) | 260.7 | 260.7 |
| Xylene (3) | (g) | 259 | 259 |
| $CO_2$ (1) | (g) | 43.7 | 43.7 |
| $CO_2$ (2) | (g) | 13.1 | 13.1 |
| Alkylaryl sulfonic acid | (g) | 120 | 120 |
| Potassium alkylsalicylate | (g) | 720 | 720 |
| Dilution oil (600N) | (g) | 181.9 | 181.9 |
| Quantity produced | (g) | 1170.5 | 1170.5 |
| Total surfactant (after dialysis[1]) | (g) | 556 | 556 |
| "Phenol"/total surfactant[2] | (wt/wt) | 0.106 | 0.106 |
| "Phenol" + "Hydroxybenzoic acid"/total surfactant | (wt/wt) | 0.82 | 0.82 |
| Total surfactant (% by weight) | | 47.50 | 47.50 |
| TBN/% total surfactant | | 3.61 | 3.83 |

[1]In order to eliminate the unreacted alkylphenols,

[2]The alkylphenates, alkylsalicylates and sulfonates were assayed in acid form

TABLE 9

| Analyses | | Examples 9 | Examples 10 |
|---|---|---|---|
| Linear alkylphenols | | | |
| CPC (C20-C28 olefin derivatives) | (%) | 100% | 50% |
| BP (C20-C28 olefin derivatives) | (%) | — | 50% |
| Molar ratio KOH/alkylphenols | | 0.9 | 0.9 |
| OVERBASING PHASE | | | |
| Analyses | | — | — |
| Potassium | wt % | 2.86 | 2.8 |
| Calcium | wt % | 5.12 | 5.44 |
| % CaS ASTM D3712 | wt % | 0.401 | — |
| TEN ASTM D2896 | mg KOH/g | 171.5 | 182 |
| Salicylic acid[1] | mg KOH/g | 34.94 | 29.44 |
| Viscosity at 100° C. ASTM D445 | $mm^2/s$ | 43.94 | 30.9 |
| Appearance in oil | MAO 23 | 1/0 | 1/0 |
| Color | ASTM D1500 | 2.6 DD | 6.2 D |
| Crude sediments ASTM D2273 | vol-% | 0.60 | 0.60 |
| Final sediments ASTM D2273 | vol-% | 0.02 | 0.01 |

[1]Expressed in mg KOH/g through ASTM D2896

Performance Testing

Formulations 9 and 10

Lubricating oil formulations prepared with the products from Examples 9 and 10 were examined in the Dispersion Test and the Hot Tube Test as described above and designated as Formulations 9 and 10. Each of the formulations tested had a TBN of 40.

Comparative Formulations D and E were also prepared and differ from Formulations 9 and 10 in that Comparative Formulation D does not contain a lubricating additive of the present invention and the TBN of 40 is contributed by the overbased calcium sulfonate alone and that the only lubricating additive contained in Comparative Formulation E is a calcium $C_{14}$-$C_{18}$ alkylarylsalicylate and overbased calcium sulfonate.

The results of these tests are presented in Table 10 below.

TABLE 10

| Performance | Examples 9 | Examples 10 | Comparative Examples D | Comparative Examples E |
|---|---|---|---|---|
| Linear alkylphenols | | | | |
| CPC (C20-C28) olefin derivatives (%) | 100% | 50% | — | — |
| BP (C20-C28) olefin derivatives (%) | — | 50% | — | — |
| Molar ratio KOH/alkylphenol | 0.9 | 0.9 | — | — |
| Formulation | | | | |
| Polybutene succinimide | 1.4% | 1.4% | 1.4% | 1.4% |
| Zinc dithiophosphate | 0.66% | 0.66% | 0.66% | 0.66% |
| Calcium C20-C24 alkylaryl sulfonate TBN 425[1] | 4.8% | 4.8% | | 4.8% |
| Quantity of product of invention[1] | 11.7% | 11.0% | | |
| Quantity comparative examples[1] | | | 9.4% | 11.7% |
| Anti-foam agent | 0.004% | 0.004% | 0.004% | 0.004% |
| 600N Base oil | 81.44% | 82.14 | 88.54 | 81.44 |
| Dispersion Test | 330 | 349 | 300 | 287 |
| 330° C. Hot Tube Test | 9 | 9 | clogged | clogged |
| Appearance after one month at 80° C. in formulation | 1/0 | 1/0 | 1/0 | 1/1 |

[1]Corresponding to TBN of 20

These results show that Formulations 9 and 10 have a positive dispersing and detergency effect, as well as thermal stability greater than Comparative Formulations D and E.

What is claimed is:

1. A lubricating oil additive comprising a product obtained by the process of:

(I) preparing a surfactant system comprising:

(A) at least one alkyl aromatic sulfonate of an alkaline-earth metal comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 10% to 70%; and (ii) from about 0 wt % to 50 wt % of a branched mono alkyl aromatic sulfonate in which the branched alkyl group contains from about 14 to 30 carbon atoms; and (B) at least one oil-soluble reactant selected from the group consisting of:

(i) an alkylhydroxybenzoic acid or the alkaline metal or alkaline-earth metal salt thereof;

(ii) a carboxylate detergent-dispersant obtained by:

(a) neutralizing alkylphenols using an alkaline-earth metal base forming an intermediate product; and (b) carboxylating the intermediate product using carbon dioxide so that at least 5 wt % of the original alkylphenol starting material has been converted to alkaline-earth metal single aromatic-ring hydrocarbyl salicylate; and (iii) a sulfurized or non-sulfurized alkylphenol or the alkaline metal or alkaline-earth metal salt thereof, wherein the alkyl group in each of (B)(i) to (B)(iii) is independently a linear or branched alkyl group, or mixture of linear and branched alkyl groups having from about 9 to 160 carbon atoms; and (II) reacting the resultant surfactant system with a source of alkaline-earth metal and at least one acidic co-agent;

wherein the proportion of salified alkylphenol surfactant in the surfactant system is less than 15 wt %.

2. The lubricating oil additive according to claim 1, wherein the alkyl group on the linear mono alkyl aromatic sulfonate contains from about 18 to 30 carbon atoms.

3. The lubricating oil additive according to claim 2, wherein the alkyl group on the linear mono alkyl aromatic sulfonate contains from about 20 to 24 carbon atoms.

4. The lubricating oil additive according to claim 1, wherein the mole % of the aromatic sulfonate group fixed on the 1 or 2 position of the linear alkyl chain is between from about 10% to 30%.

5. The lubricating oil additive according to claim 4, wherein the mole % of the aromatic sulfonate group fixed on the 1 or 2 position of the linear alkyl chain is between from about 13% to 25%.

6. The lubricating oil additive according to claim 5, wherein the mole % of the aromatic sulfonate group fixed on the 1 or 2 position of the linear alkyl chain is between from about 15% to 25%.

7. The lubricating oil additive according to claim 1, wherein the linear mono alkyl group of the linear mono alkyl aromatic sulfonate defined in (A)(i) of claim 1 is derived from a normal alpha olefin containing from about 18 to 40 carbon atoms.

8. The lubricating oil additive according to claim 7, wherein the linear mono alkyl group of the linear mono alkyl aromatic sulfonate defined in (A)(i) of claim 1 is derived from a normal alpha olefin containing from about 20 to 24 carbon atoms.

9. The lubricating oil additive according to claim 1, wherein the branched mono alkyl group of the branched mono alkyl aromatic sulfonate defined in (A)(ii) of claim 1 contains from about 14 to 18 carbon atoms.

10. The lubricating oil additive according to claim 1, wherein the branched mono alkyl aromatic sulfonate defined in (A)(ii) of claim 1 is derived from a polymer of propylene.

11. The lubricating oil additive according to claim 1, wherein the branched alkyl group in each of (B)(i) to (B)(iii) independently contains from about 12 to 50 carbon atoms.

12. The lubricating oil additive according to claim 1, wherein at least 10 wt % of the alkyl groups in each of (B)(i) to (B)(iii) is a linear alkyl group having from about 18 to 30 carbon atoms.

13. The lubricating oil additive according to claim 12, wherein at least 20 wt % of the alkyl groups in each of (B)(i) to (B)(iii) is a linear alkyl group having from about 18 to 30 carbon atoms.

14. The lubricating oil additive according to claim 13, wherein at least 50 wt % of the alkyl groups in each of (B)(i) to (B)(iii) are linear alkyl having from about 18 to 30 carbon atoms.

15. The lubricating oil additive according to claim 1, wherein at least 10 wt % of the alkyl groups in each of (B)(i) to (B)(iii) are linear alkyl having from about 18 to 30 carbon atoms when (B) is at least one of (B)(i) or (B)(ii).

16. The lubricating oil additive according to claim 15, wherein at least 20 wt % of the alkyl groups in each of (B)(i) to (B)(iii) is a linear alkyl group having from about 18 to 30 carbon atoms when (B) is at least one of (B)(i) or (B)(ii).

17. The lubricating oil additive according to claim 1, wherein at least 10 wt % of the original alkylphenol starting material defined in (B)(ii)(b) has been converted to alkaline-earth metal single aromatic-ring hydrocarbyl salicylate.

18. The lubricating oil additive according to claim 17, wherein at least 20 wt % of the original alkylphenol starting material defined in (B)(ii)(b) has been converted to alkaline-earth metal single aromatic-ring hydrocarbyl salicylate.

19. The lubricating oil additive according to claim 1, wherein the alkaline-earth metal is calcium.

20. The lubricating oil additive according to claim 1, wherein the acidic co-agent is carbon dioxide or boric acid or mixtures thereof.

21. The lubricating oil additive according to claim 1, wherein the Total Base Number of the lubricating additive is greater than about 250.

22. The lubricating oil additive according to claim 21, wherein the Total Base Number of the lubricating additive is greater than about 400.

23. A process for making a lubricating oil composition comprising mixing a base oil of lubricating viscosity and the lubricating oil additive of claim 1.

24. A lubricating oil composition comprising:

(A) a major amount of a base oil of lubricating viscosity, and (B) a minor amount of the lubricating oil additive of claim 1.

25. A method of lubricating a hydraulic system in land and marine engines comprising contacting the hydraulic system with the lubricating oil composition of claim 24.

26. A lubricating oil additive comprising a product obtained by the process of:

(I) preparing a surfactant system comprising:

(A) at least one alkyl aromatic sulfonate of an alkaline-earth metal comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 10% to 70%; and (ii) from about 0 wt % to 50 wt % of a branched mono alkyl aromatic sulfonate in which the branched alkyl group contains from about 14 to 30 carbon atoms; and (B) at least one oil-soluble reactant selected from the group consisting of:

(i) an alkylhydroxybenzoic acid or the potassium or alkaline-earth metal salt thereof;

(ii) a carboxylate detergent-dispersant obtained by:

(a) neutralizing alkylphenols using an alkaline-earth metal base forming an intermediate product; and (b) carboxylating the intermediate product using carbon dioxide so that at least 5 wt % of the original alkylphenol starting material has been converted to alkaline-earth metal single aromatic-ring hydrocarbyl salicylate; and (iii) a sulfurized or non-sulfurized alkylphenol or the alkaline-earth metal salt thereof, wherein the alkyl group in each of (B)(i) to (B)(iii) is independently a linear or branched alkyl group, or mixture of linear and branched alkyl groups having from about 9 to 160 carbon atoms; and (II) reacting the resultant surfactant system with a source of alkaline-earth metal and at least one acidic co-agent;

wherein the proportion of salified alkylphenol surfactant in the surfactant system is less than 15 wt %.

27. A lubricating oil additive, comprising a product obtained by the process of:

(I) preparing a surfactant system comprising:

(A) at least one calcium alkyl aromatic sulfonate comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 10% to 70%; and (ii) from about 0 wt % to 50 wt % of a branched mono alkyl aromatic sulfonate in which the branched alkyl group contains from about 14 to 30 carbon atoms; and (B) at least one oil-soluble reactant selected from the group consisting of:

(i) an alkylhydroxybenzoic acid or the potassium or calcium salt thereof;

(ii) a carboxylate detergent-dispersant obtained by:

(a) neutralizing alkylphenols using a calcium base forming an intermediate product; and (b) carboxylating the intermediate product using carbon dioxide so that at least 5 wt % of the original alkylphenol starting material has been converted to a calcium single aromatic-ring hydrocarbyl salicylate; and (iii) a sulfurized or non-sulfurized alkylphenol or the calcium salt thereof, wherein the alkyl group in each of (B)(i) to (B)(iii) is independently a linear or branched alkyl group, or mixture of linear and branched alkyl groups having from about 9 to 160 carbon atoms; and (II) reacting the resultant surfactant system with a source of calcium and at least one acidic co-agent;

wherein the proportion of salified alkylphenol surfactant in the surfactant system is less than 15 wt %.

28. A lubricating oil composition comprising:

(A) a major amount of a base oil of lubricating viscosity, and (B) a minor amount of the lubricating oil additive of claim 26.

29. A lubricating oil composition comprising:

(A) a major amount of a base oil of lubricating viscosity, and (B) a minor amount of the lubricating oil additive of claim 27.

30. A lubricating oil additive comprising a product obtained by the process of:

(I) preparing a surfactant system comprising:

(A) at least one alkyl aromatic sulfonate of an alkaline-earth metal comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 10% to 70%; and (ii) from about 0 wt % to 50 wt % of a branched mono alkyl aromatic sulfonate in which the branched alkyl group contains from about 14 to 30 carbon atoms; and (B) at least one oil-soluble reactant selected from the group consisting of:

(i) an alkylhydroxybenzoic acid or the alkaline metal or alkaline-earth metal salt thereof; and (ii) a carboxylate detergent-dispersant obtained by:

(a) neutralizing alkylphenols using an alkaline-earth metal base forming an intermediate product; and (b) carboxylating the intermediate product using carbon dioxide so that at least 5 wt % of the original alkylphenol starting material has been converted to alkaline-earth metal single aromatic-ring hydrocarbyl salicylate;

wherein the alkyl group in each of (B)(i) to (B)(ii) is independently a linear or branched alkyl group, or mixture of linear and branched alkyl groups having from about 9 to 160 carbon atoms; and (II) reacting the resultant surfactant system with a source of alkaline-earth metal and at least one acidic co-agent.

31. A lubricating oil composition comprising:

(A) a major amount of a base oil of lubricating viscosity, and (B) a minor amount of the lubricating oil additive of claim 30.

32. A lubricating oil additive comprising a product obtained by the process of:

(I) preparing a surfactant system comprising:

(A) at least one alkyl aromatic sulfonate of an alkaline-earth metal comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 10% to 70%; and (ii) from about 0 wt % to 50 wt % of a branched mono alkyl aromatic sulfonate in which the branched alkyl group contains from about 14 to 30 carbon atoms; and (B) at least one oil-soluble reactant consisting of an alkylhydroxybenzoic acid or the alkaline metal or alkaline-earth metal salt thereof, wherein the alkyl group is independently a linear or branched alkyl group, or mixture of linear and branched alkyl groups having from about 9 to 160 carbon atoms; and (II) reacting the resultant surfactant system with a source of alkaline-earth metal and at least one acidic co-agent.

33. A lubricating oil composition comprising:

(A) a major amount of a base oil of lubricating viscosity, and (B) a minor amount of the lubricating oil additive of claim 32.

34. A lubricating oil additive comprising a product obtained by the process of:

(I) preparing a surfactant system comprising:

(A) at least one alkyl aromatic sulfonate of an alkaline-earth metal comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 10% to 70%; and (ii) from about 0 wt % to 50 wt % of a branched mono alkyl aromatic sulfonate in which the branched alkyl group contains from about 14 to 30 carbon atoms; and (B) at least one oil-soluble reactant consisting of a carboxylate detergent-dispersant obtained by:

(i) neutralizing alkylphenols using an alkaline-earth metal base forming an intermediate product; and (ii) carboxylating the intermediate product using carbon dioxide so that at least 5 wt % of the original alkylphenol starting material has been converted to alkaline-earth metal single aromatic-ring hydrocarbyl salicylate;

wherein the alkyl group is independently a linear or branched alkyl group, or mixture of linear and branched alkyl groups having from about 9 to 160 carbon atoms; and (II) reacting the resultant surfactant system with a source of alkaline-earth metal and at least one acidic co-agent.

35. A lubricating oil composition comprising:

(A) a major amount of a base oil of lubricating viscosity, and (B) a minor amount of the lubricating oil additive of claim 34.

36. A lubricating oil additive comprising a product obtained by the process of:

(I) preparing a surfactant system comprising:

(A) at least one alkyl aromatic sulfonate of an alkaline-earth metal comprising:

(i) from about 50 wt % to 100 wt % of a linear mono alkyl aromatic sulfonate in which the linear mono alkyl group contains from about 14 to 40 carbon atoms, and the mole % of the aromatic sulfonate group fixed on the 1 or 2 position of the linear alkyl chain is from about 10% to 70%; and (ii) from about 0 wt % to 50 wt % of a branched mono alkyl aromatic sulfonate in which the branched alkyl group contains from about 14 to 30 carbon atoms; and (B) at least one oil-soluble reactant consisting of a sulfurized or non-sulfurized alkylphenol or the alkaline metal or alkaline-earth metal salt thereof, wherein the alkyl group is independently a linear or branched alkyl group, or mixture of linear and branched alkyl groups having from about 9 to 160 carbon atoms; and (II) reacting the resultant surfactant system with a source of alkaline-earth metal and at least one acidic co-agent;

wherein the proportion of salified alkylphenol surfactant in the surfactant system is less than 15 wt %.

37. A lubricating oil composition comprising:

(A) a major amount of a base oil of lubricating viscosity, and (B) a minor amount of the lubricating oil additive of claim 36.

* * * * *